US008474092B2

(12) United States Patent
Chong et al.

(10) Patent No.: US 8,474,092 B2
(45) Date of Patent: Jul. 2, 2013

(54) VACUUM CLEANER

(75) Inventors: Chung Ook Chong, Gwangmyeong-si (KR); Kie Tak Hyun, Seoul (KR)

(73) Assignee: LG Electronics Inc., Seoul (KR)

( * ) Notice: Subject to any disclaimer, the term of this patent is extended or adjusted under 35 U.S.C. 154(b) by 320 days.

(21) Appl. No.: 12/915,143

(22) Filed: Oct. 29, 2010

(65) Prior Publication Data

US 2011/0099750 A1 May 5, 2011

Related U.S. Application Data

(60) Provisional application No. 61/257,028, filed on Nov. 1, 2009.

(51) Int. Cl.
*A47L 9/18* (2006.01)

(52) U.S. Cl.
USPC ..... 15/347; 15/352; 15/353

(58) Field of Classification Search
USPC ..... 15/347–353
IPC ..... A47L 9/10
See application file for complete search history.

(56) References Cited

U.S. PATENT DOCUMENTS

| | | | | |
|---|---|---|---|---|
| 7,600,293 | B2 * | 10/2009 | Lee et al. | 15/352 |
| 7,611,558 | B2 * | 11/2009 | Oh et al. | 55/432 |
| 7,770,253 | B2 * | 8/2010 | Ha et al. | 15/319 |
| 7,992,253 | B2 * | 8/2011 | Yun et al. | 15/352 |
| 8,060,979 | B2 * | 11/2011 | Hwang et al. | 15/352 |
| 2009/0241286 | A1 * | 10/2009 | Hwang et al. | 15/347 |
| 2009/0255083 | A1 * | 10/2009 | Hwang et al. | 15/347 |

* cited by examiner

*Primary Examiner* — David Redding
(74) *Attorney, Agent, or Firm* — Birch, Stewart, Kolasch & Birch, LLP

(57) ABSTRACT

A vacuum cleaner is disclosed. The present invention relates to a vacuum cleaner that is able to form dust and foreign substances collected in a dust collection device provided therein in a single mass shape to discharge it efficiently, not scattered in a dust collecting device. The vacuum cleaner includes a body, a dust separation device mounted in the body, a dust collection device independently provided from the dust separation device, connected to the dust collection device, a compression device provided in the dust collection device, to collect dust and foreign substances collected in a predetermined portion of the dust collection device and to compress the collected dust and foreign substances, and a liquid supply device provided in the dust separation device to supply liquid material to the dust separation device.

17 Claims, 14 Drawing Sheets

VACUUM CLEANER

Pursuant to 35 U.S.C. §119(a), this application claims the benefit of earlier filing date and right of priority to U.S. Provisional patent Application No. 61/257,028, filed on Nov. 1, 2009, the contents of which are hereby incorporated by reference herein in their entirety.

BACKGROUND OF THE INVENTION

1. Field of the Invention

The present invention relates to a vacuum cleaner, more specifically, to a vacuum cleaner that is able to prevent scattering of dust and other foreign substances by spraying predetermined liquid material when cleaning a dust collection device, only to improve user convenience.

2. Discussion of the Related Art

Generally, vacuum cleaners are electric appliances that are able to remove dust and foreign substances placed on floors or furniture of buildings via a mechanism that sucks external air by using a vacuum pressure.

Such a vacuum cleaner may be categorized into a canister type and an up-right type. In a canister type vacuum cleaner, a body and a suction nozzle are independently connected to a predetermine pipe. In an up-right type, the body and the suction nozzle are integrally provided.

The conventional vacuum cleaner typically includes a suction nozzle, a dust separation device, a dust collection device, a vacuum motor and a filter. Here, the dust separation device separates air and foreign substances sucked by the suction nozzle by using a cyclone theory.

The dust collection device is connected to a foreign substance outlet of the dust separation device and it collects dust and other foreign substances. The vacuum motor is connected to an air outlet of the dust separation device and it forms a vacuum pressure. The filter is connected to an outlet of the vacuum pump and it filters air exhausted outside.

When the user starts the vacuum cleaner having the above configuration, air and foreign substance having passed the suction nozzle are rotating in the dust separation device. Some of the foreign substances having a large mass are rotated along an inner circumferential surface of the dust separation device by a centrifugal force thereof, only to be drawn into the dust collection device.

The purified air is exhausted outside via the motor and the filter.

However, if dust and other foreign substances accumulate in the dust collection device according to the conventional vacuum cleaner, their light mass would make the dust and other foreign substances scattered in the dust collection device. In addition, if the user takes out the dust collection device only to throw the dust substances out, the dust substances would be scattered.

SUMMARY OF THE INVENTION

To solve the problems, an object of the present invention is to provide a vacuum cleaner that is able to make dust and other foreign substances collected in a dust collection device into a mass having a predetermined size, without scattering.

Furthermore, another object of the present invention is to provide a vacuum cleaner that is able to collect and to throw out dust and other foreign substances efficiently without scattering.

To achieve these objects and other advantages and in accordance with the purpose of the invention, as embodied and broadly described herein, a vacuum cleaner includes a body; a dust separation device mounted in the body; a dust collection device independently provided from the dust separation device, connected to the dust collection device; a compression device provided in the dust collection device, to collect dust and foreign substances collected in a predetermined portion of the dust collection device and to compress the collected dust and foreign substances; and a liquid supply device provided in the dust separation device to supply liquid material to the dust separation device.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION OF THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
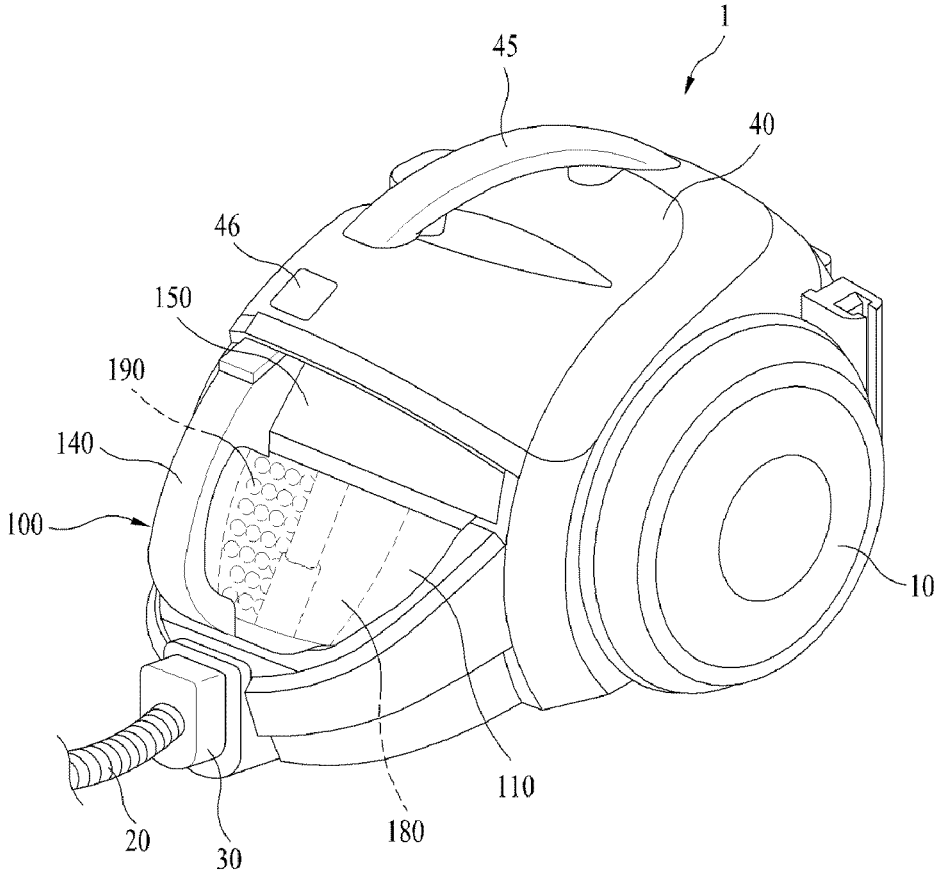
FIG. 1 is a perspective view illustrating a vacuum cleaner according to an exemplary embodiment of the present invention.

As shown in FIG. 1, a vacuum cleaner according to an exemplary embodiment of the present invention includes a body 1, a suction part 30, and wheels 10. The suction part 30 provided in a front portion of the body 1 and a connection tube 20 connected to a suction nozzle (not shown) is provided in the suction part 30. The wheel 10 is provided in each side of the body 1 to allow the body 1 to move smoothly.

A cover member 40 is provided in a top of the body 1 to protect inner configurations and a handle 45 is provided on the cover member 40 for a user to grab efficiently.

A securing member 46 is provided on a front portion of the cover member 40 and the securing member 46 is combined of a button and a latch to secure the cover member 40 to the body 1 detachably.

A dust collection device 100 is provided in a front portion of the body and the dust collection device 100 collects dust and other foreign substances. Here, the dust collection device 100 may be formed of transparent material such that the collected dust and other foreign substances may be visible from outside.

The dust collection device 100 includes a dust collecting box 110 for collecting the dust and other foreign substances therein, a handle 140 secured to the dust collecting box 110 and a dust collecting box cover 150 for covering a top of the dust collecting box 110.

A compression device is provided in the dust collecting box 110 and it moves dust and other foreign substances to a predetermined portion inside the dust collecting box 110 along a measurement direction and then it compresses the moved dust and foreign substances. Here, the compression device is configured of a fixed plate 180 and a rotating plate 190.

Figure 2:
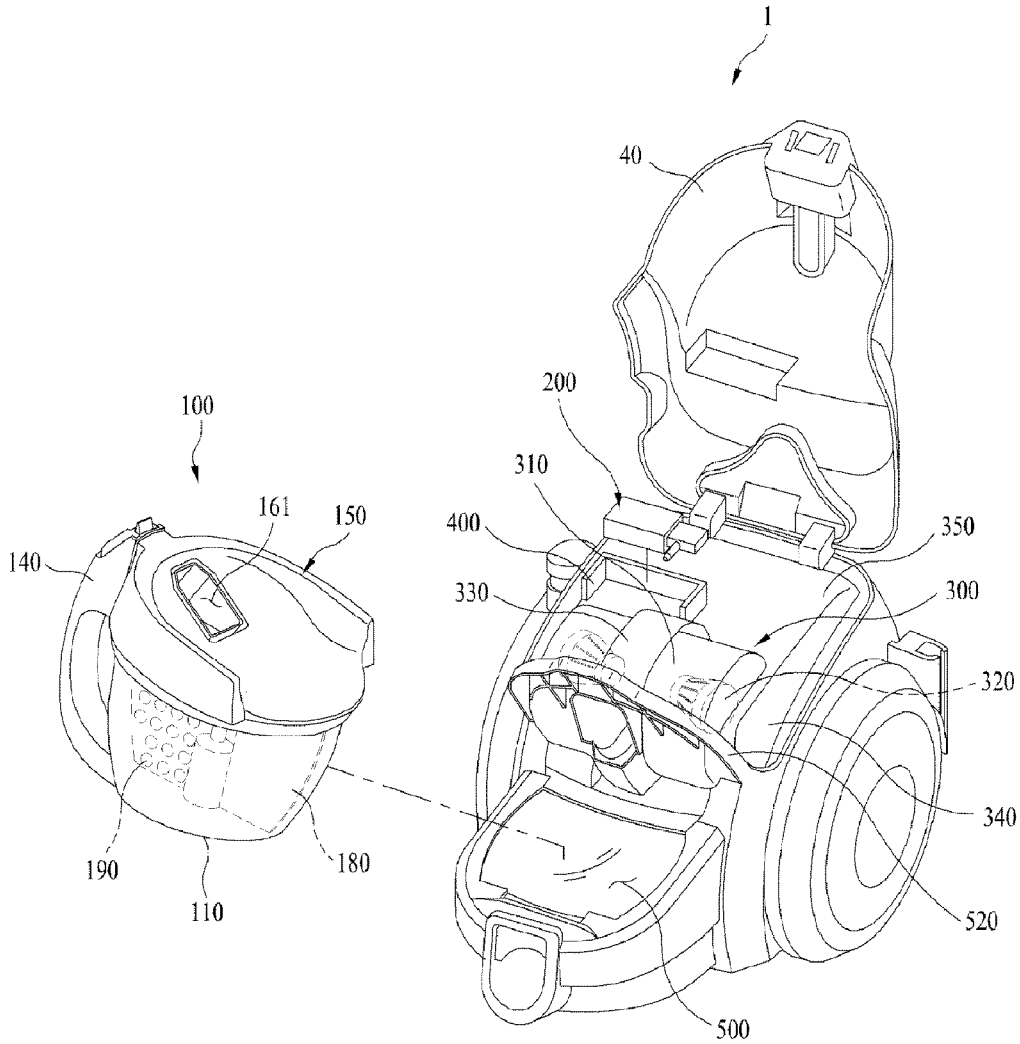
FIG. 2 is an exploded perspective view illustrating a body of the vacuum cleaner according to the exemplary embodiment of the present invention.

As shown in FIG. 2, a dust separation device 300 is provided in the body 1 to separate dust and air. Here, the dust separation device 300 may be configured of a cyclone system and the present invention is not limited thereto.

Here, the separation device 300 may include a body part 310 having a cylindrical shape, air outlet members 320 provided in both side portions inside the body part 310, with a plurality of through holes, and an outlet part 330 provided in a center of the body part 310 to exhaust the dust separated from the air.

An inlet part (not shown) is provided in a lower portion of the body part 310 to suck external air and dust therein and an air guiding part 340 provided in both side portions of the body part 310 to guide the motion of the air having passed the air outlet members 320.

Here, a first filtering unit 350 is provided in rear of the body part 310 to filter the air discharged from the body part 310 and the first filtering unit 350 is connected to the body part 310 by the air guide part 340.

A motor unit (360, see FIG. 12) is provided below the dust separation device 300 and the motor unit forms a vacuum pressure to suck air. The motor unit 360 is connected to the first filtering unit 350 and it discharges the air outside the body 1 after sucking the air having passed the first filtering unit 350.

A dust collection device accommodating part 500 is provided in a front portion of the body 1 and the dust collection device accommodating part 500 partially accommodates the dust collection device 100. The dust collection device accommodating part 500 is formed in a hemisphere shape and the dust collection device 100 is detachably accommodated in the dust collection device accommodating part 500.

A connection plate 520 is provided between the dust separation device 300 and the dust collection device 100 and the handle 140 of the dust collection device 100 is detachably connected to a lower surface of the connection plate 520.

A front portion of the cover member 40 is detachably connected to an upper surface of the connection plate 520.

Also, an end of an outlet part 330 of the dust separation device 300 is connected to the connection plate 520 and an inlet 161 of the dust collection device 140 is connected to the connection plate 520.

Here, the inlet 161 is formed in the dust collecting box cover 150.

The dust and other foreign substances rotating within the dust separation device 300 are moved along the outlet part 330 by a centrifugal force thereof, only to be sucked into the inlet 161 of the dust collection device 100. After that, the dust and other foreign substances are collected in the dust box 110.

A liquid supply device 200 is provided in a predetermined portion of the dust separation device 300 and the liquid supply device 200 supplies predetermined liquid material to the dust separation device 300.

That is, when they are moved to the dust collection device 100 along the guide of the outlet part 330, with being rotated along an inner circumferential surface of the body part 310 by a centrifugal force thereof, the dust and other foreign substances are mixed with the liquid material.

If then, the weights of the dust and other foreign substances increase enough to increase the centrifugal force. The increased centrifugal force makes the separation of the air smoothly such that the dust and other foreign substances may be sucked into the dust collection device 100 more smoothly.

In case dust and other foreign substances are collected in the dust collecting box 110 of the dust collection device 100, adhesion among the dust and foreign substances may be increased enough to be mass-shaped.

Especially, in case the dust and other foreign substances are compressed and collected near the fixed plate 180 by the rotation of the rotating plate 190, the formation of the mass-shaped dust and other foreign substances may be performed more efficiently.

Figure 3:
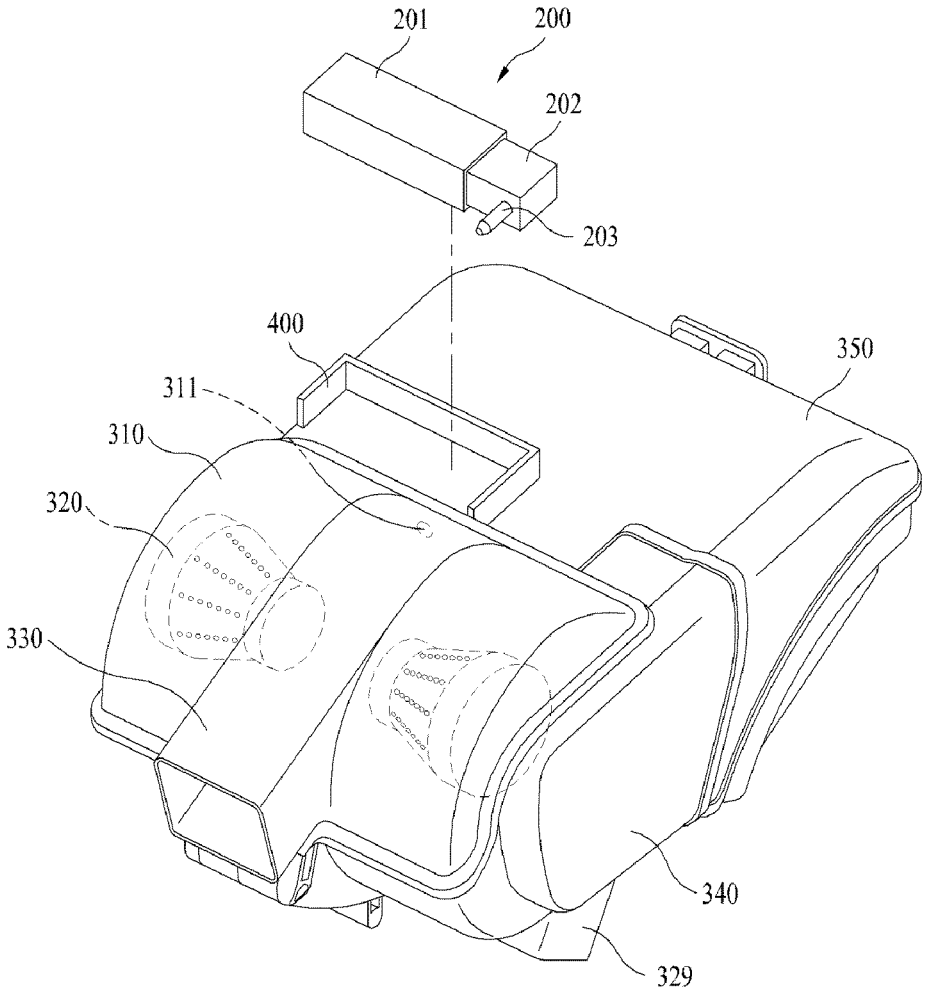
FIG. 3 is a perspective view illustrating a liquid supply device and a dust separation device provided in the vacuum cleaner according to a first embodiment of the present invention.

As shown in FIG. 3, the liquid supply device 200 is installed on an outer surface of the body part 310, specifically, a rear portion of the outer surface of the body part 310.

The liquid supply device 200 may be detachably installed to the dust separation device 300 and a rib member 400 is provided in the dust separation device 300 to support the liquid supply device 200.

The rib member 400 may surround the liquid supply device 200.

The liquid supply device 200 includes an accommodating part 201 for accommodating the liquid material therein and an exhaustion pump 202 for exhausting the liquid material received in the accommodating part 201 into the body part 310.

A guiding tube 203 is provided in the exhaustion pump 202 and the liquid material exhausted from the exhaustion pump 202 is drawn into the body part 310 along the guiding tube 203.

Here, a diameter of an end of the guiding tube 203 is smaller than diameters of the other portions to exhaust the liquid material from the guiding tube 203 in a spraying type.

An outlet hole 311 is provided in the body part 310 and the guiding tube 203 is inserted in the outlet hole 311 such that the liquid material may be exhausted.

The outlet part 330 is provided in a center portion of the body part 310 and the air outlet members 320 are arranged in both opposite sides of the inner surface of the body part 310.

The inlet part 329 is provided in a lower surface of the body part 310 to guide the air, dust and other foreign substances toward the body part 310.

As a result, if the vacuum cleaner according to the present invention is put into operation, the air, dust and other foreign substances sucked via the inlet part 329 are moved inside the body part 310. The dust and other foreign substances are moved to the outlet part 330 located in the center of the body part 310 by their weights, with rotated along the inner circumferential surface of the body part 310.

Hence, the dust and foreign substances are collected in the dust collection device (100, see FIG. 2).

Here, the air having the dust and other foreign substances removed there from is flowing to the air outlet member 320 and it passes the first filtering unit 350 along the guide of the air guiding part 340.

The first filtering unit 350 filters minute dust contained in the air.

An inner surface of the dust separation device 300 may be coated with special material that is able to make the liquid material flow down along the surface, not smeared on the inner surface. Otherwise, the inner surface of the dust separation device 300 will be soiled by the liquid material and the mixture of the liquid material and the dust substances.

In the meanwhile, the dust and other foreign substances may meet the liquid material before being moved into the dust collection device 100 and they are moved into the dust collection device 100, mixed with the liquid material.

Figure 4:
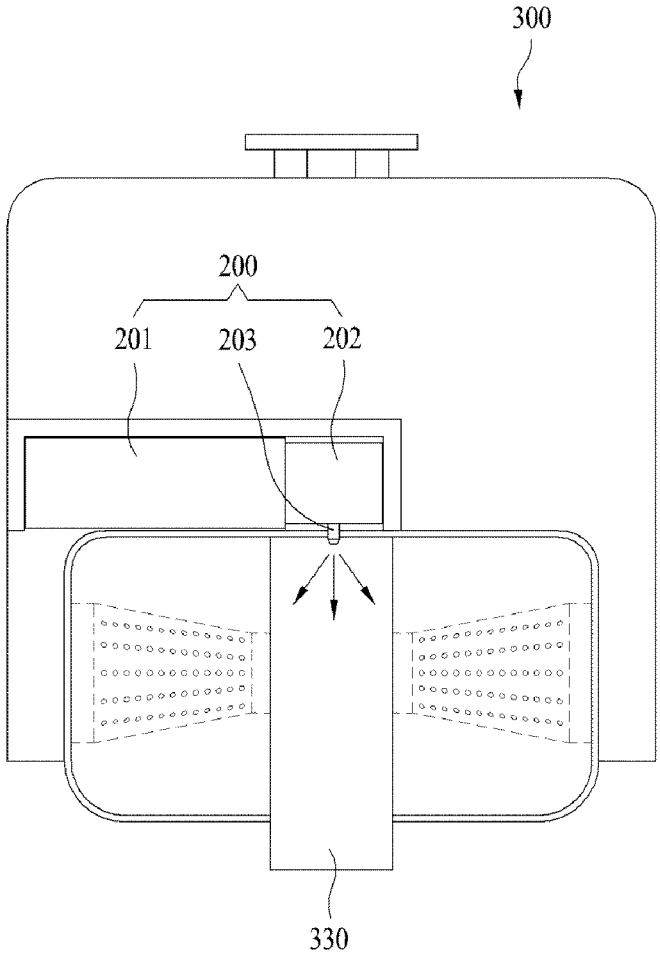
FIG. 4 is a plane view illustrating the liquid supply device and the dust separation device according to the first embodiment of the present invention.

As shown in FIG. 4, the guiding tube 203 is located on a center line in rear of the outlet part 330 and thus the liquid material may be sprayed to the dust and other foreign substances moving toward the outlet part 330 from the air outlet members 320 provided in both opposite sides of the outlet part 330.

The liquid material may be sprayed widely, because the guiding tube 203 is located on the center line in rear of the outlet part 330.

The dust and other foreign substances mixed with the liquid material may be discharged toward the dust collection device (100, see FIG. 2) along the outlet part 330.

Figure 5:
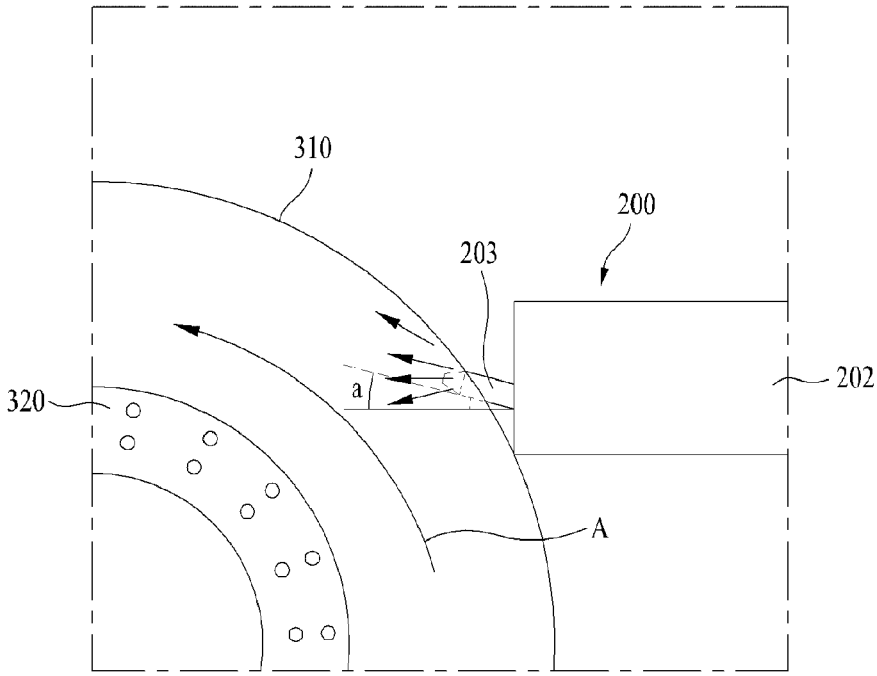
FIG. 5 is a side-sectional view illustrating the liquid supply device and the dust separation device according to the first embodiment of the present invention.

As shown in FIG. 5, the guiding tube 203 may be arranged oblique to a predetermined angle (a) toward a rotational direction (A) of the dust and other foreign substances.

This is because the spraying direction of the liquid material sprayed from the guiding tube 203 should be similar to the moving direction of the dust and other foreign substances.

In other words, the guiding tube 203 may be arranged as mentioned above in order to mix the dust and other foreign substances with the liquid material, without making the spraying of the liquid material interfere with the rotation of the dust and other foreign substances.

Here, in case the dust and other foreign substances are rotated from a bottom direction toward a top direction, the guiding tube 203 may be formed oblique upward.

Alternatively, in case that rotation is performed from the top toward the bottom direction, the guiding tube 203 may be formed oblique downward.

Such the oblique formation may be applicable to all of the other following embodiments commonly.

Figure 6:
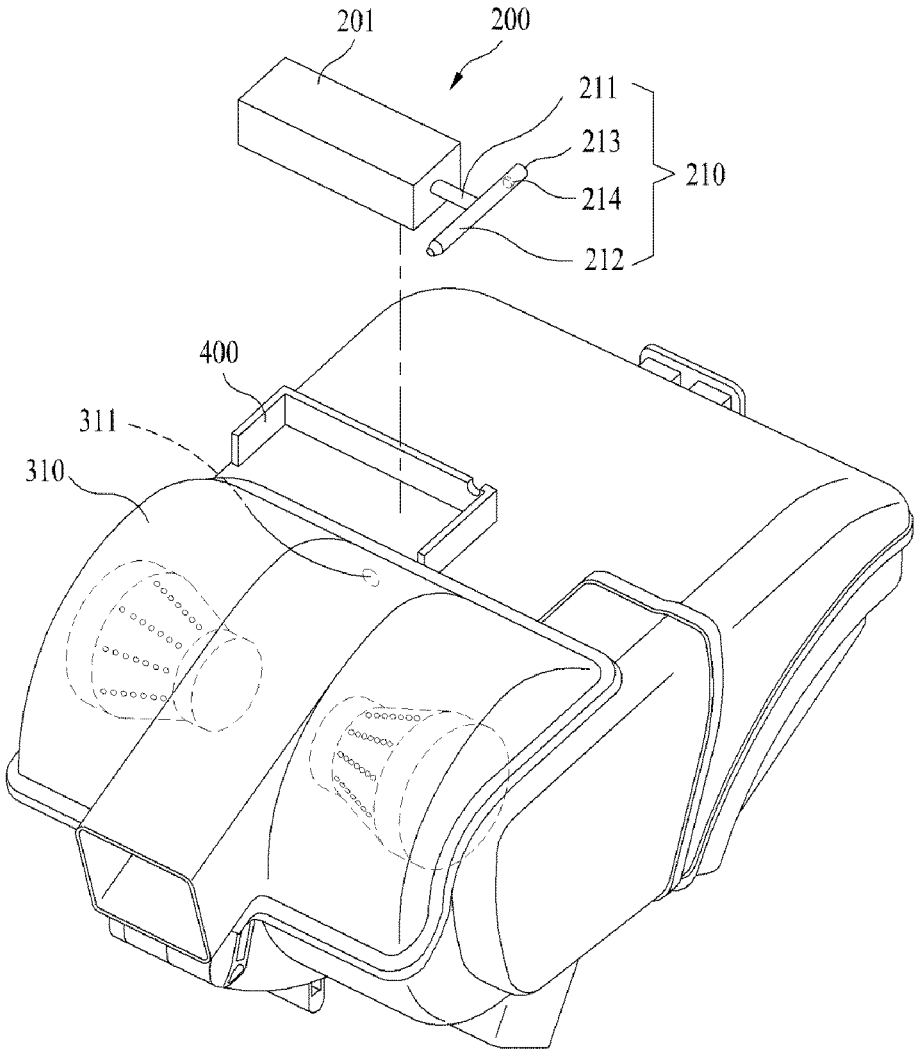
FIG. 6 is a perspective view illustrating a liquid supply device and a dust separation device of a vacuum cleaner according to a second embodiment of the present invention.

FIG. 6 illustrates another embodiment of the liquid supply device 200. Here, the liquid supply device 200 includes a storage part 201 for storing the liquid material therein and a guiding tube 210 for guiding the liquid material of the storage part 201 into the body part 310.

The guiding tube 210 includes a first guiding tube 211 connected to the storage part 201, a second guiding tube 212 connected to the first guiding tube 211 to be inserted in the body part 310 and a third guiding tube 213 connected to both of the first and second guiding tubes 211 and 212 to guide external air toward the second guiding tube 212.

A closable valve 214 is provided in the third guiding tube 213 to open and close the third guiding tube 213 to make air outside the body part 310 flow into the body part 310 in case the pressure inside the body part 310 is lower than the pressure outside the body part 310 according to the operation of the vacuum cleaner.

An outlet hole 311 is provided in the body part 310 and the outlet hole 311 is inserted in the second guiding tube 212 to discharge the liquid material there through. A diameter of an end of the second guiding tube 212 may be smaller than diameters of the other portions of the second guiding tube 212 such that the liquid material may be discharged in a spray condition.

A rib member 400 may be provided in rear of the body part 310 to prevent the detachment of the liquid supply device 200.

Figure 7:
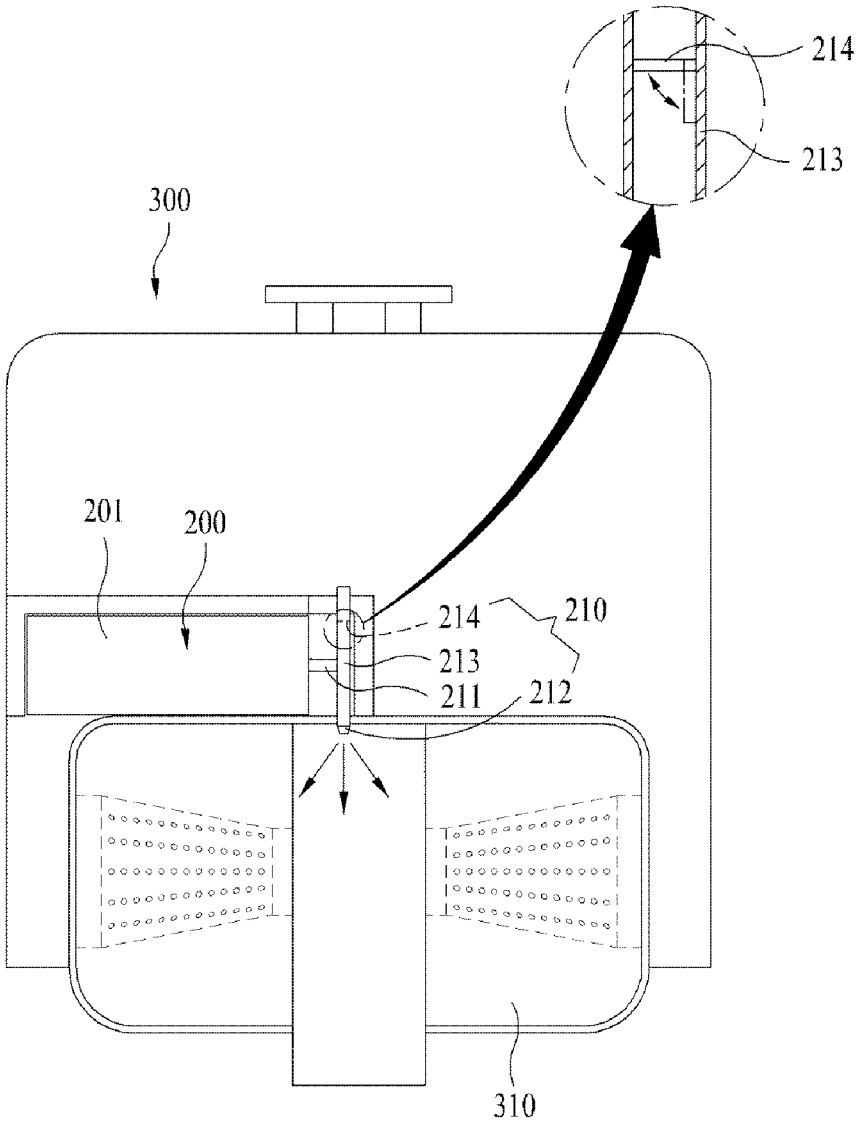
FIG. 7 is a plane view illustrating the liquid supply device and the dust separation device according to the second embodiment of the present invention.

As shown in FIG. 7, the guiding tube 210 may be located on a center line extended from the rear portion of the body part 310 to spray the liquid material more broadly.

Specifically, the end of the second guiding tube 212 may be inserted in the body part 310 and the third guiding tube 213 may be extended from the second guiding tube rearward.

A closable valve 214 provided in the third guiding tub 213 may be diversified and this embodiment presents a plate type closable valve fixed to a predetermined surface of the third guiding tube 213, with elasticity.

That is, if the inside of the body part is not low-pressured in comparison to the outside because of a stop state of the vacuum cleaner, the closable valve 214 maintains a closing state of the third guiding tube 213 to prevent foreign substances from being drawn into the body part 310.

In case the inside of the body part 310 is low-pressured in comparison to the outside because of an operational state of the vacuum cleaner, the closable valve 214 is bent toward the body part 310 and the inside of the third guiding tub 214 is opened.

Hence, external air moves along the third guiding tub 214 into the body part 310.

At this time, the flow of the air makes the pressure near a connection portion among the first, second and third guiding tubes 211, 212 and 213 is lower than the storage part.

Because of that, the liquid material inside the storage part 210 flows along the first guiding tube 211 and it reaches the connection portion among the first, second and third guiding tubes 211, 212 and 213. After that, the liquid material is drawn into the body part 310 along the flow of the air.

A diameter of the end of the second guiding tube 212 is smaller than diameters of the other portions of the second guiding tube 212 to supply the liquid material having passed the second guiding tube 212 to the body part 310 dispersedly in a spray condition.

Figure 8:
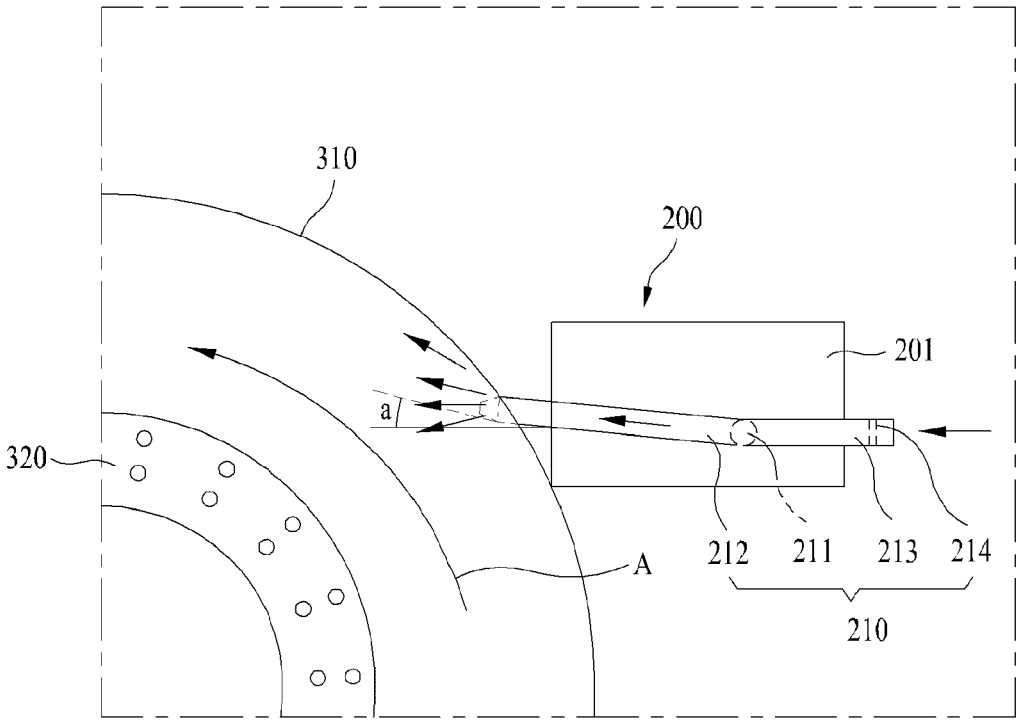
FIG. 8 is a side-sectional view illustrating the liquid supply device and the dust separation device according to the second embodiment of the present invention.

As shown in FIG. 8, the end of the second guiding tube 212 is inserted in the body part 310, oblique to a predetermined angle toward the rotational direction (A) of the dust and other foreign substances.

The reason why the end of the second guiding tube 212 has such the oblique is that the spraying direction of the liquid material is preferably corresponding to the rotational direction of the dust and other foreign substances to mix the liquid material with the dust and other foreign substances more efficiently, not making the spraying of the liquid material interfere with the rotation of the dust substances.

Here, in case the dust and other foreign substances are rotated from the bottom toward the top of the body part 310, the end of the second guiding tub 212 may be arranged oblique upward.

If such the rotation is performed from the top toward the bottom, the oblique of the second guiding tub 212 may be formed downward.

Figure 9:
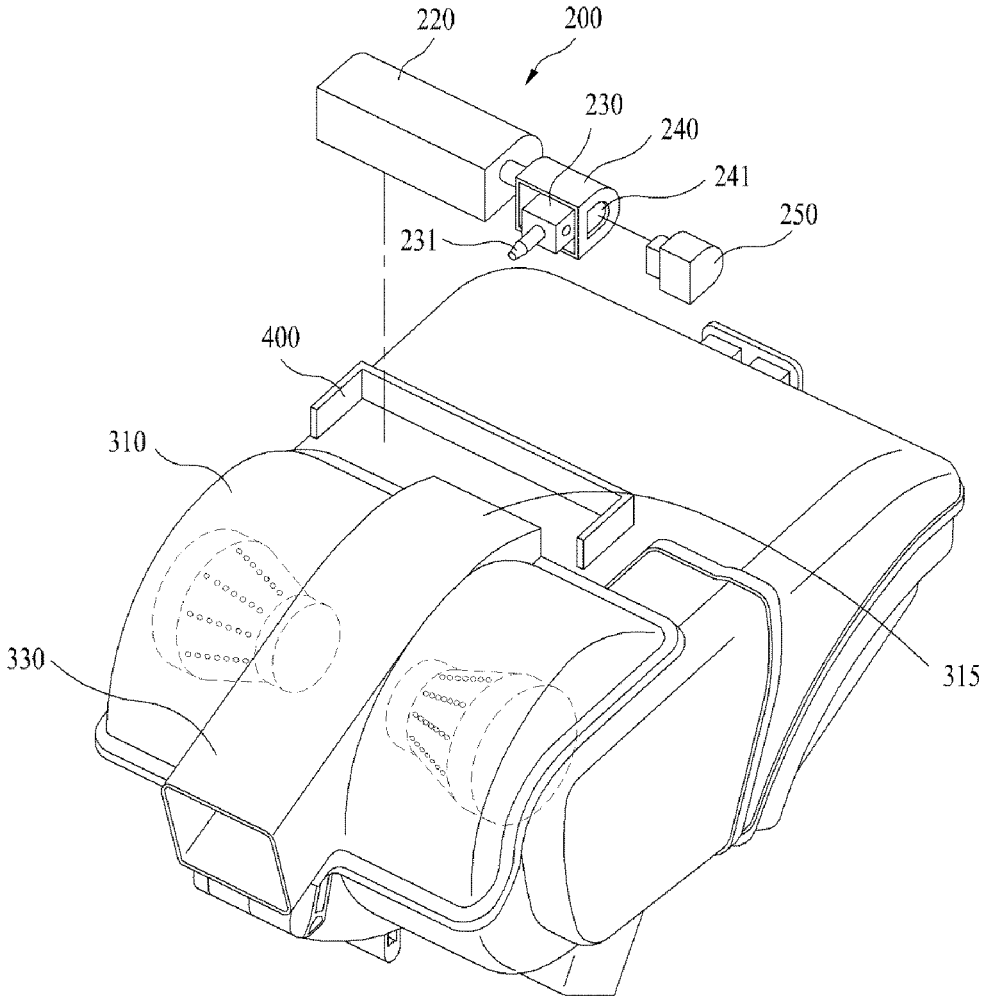
FIG. 9 is a perspective view illustrating a liquid supply device and a dust separation device according to a third embodiment of the present invention.

FIG. 9 illustrates the liquid supply device 200 configured of a spray device.

Here, a spray type liquid supply device 200 includes a storage tank 220, a spraying part 230 connected to the storage tank 220 to spray the liquid material and a spraying housing 240 for accommodating the spraying part 230.

A button part 241 is provided in a predetermined surface of the spraying housing 240 and the button part 241 operates the spraying part 230. In addition, a driving part 250 is provided in a predetermined side of the spraying housing 240 and the driving part 250 pushes the button part 241 to start operation.

Here, the driving part 250 is configured of an electronic motor and it pushes the button part 241 periodically to supply the liquid material to the body part 310 periodically.

The liquid supply device 200 may be detachably provided in rear of the body part 310, secured in the rib member 400.

An extended part 315 extended from the body part 310 rearward is provided in a rear portion of the outlet part 330 exhausting the dust and other foreign substances and the spraying housing 240 is coupled to the extended part 315.

As the spraying housing 240 is coupled to the extended part 315, a guiding tube 231 is inserted in the body part 310 and it is possible to spray the liquid material into the body part 310.

The air outlet member 320, the air guiding member 340, the outlet part 330 and the inlet part 329 are identical to those of the above embodiments and their detailed descriptions will be omitted accordingly.

Figure 10:
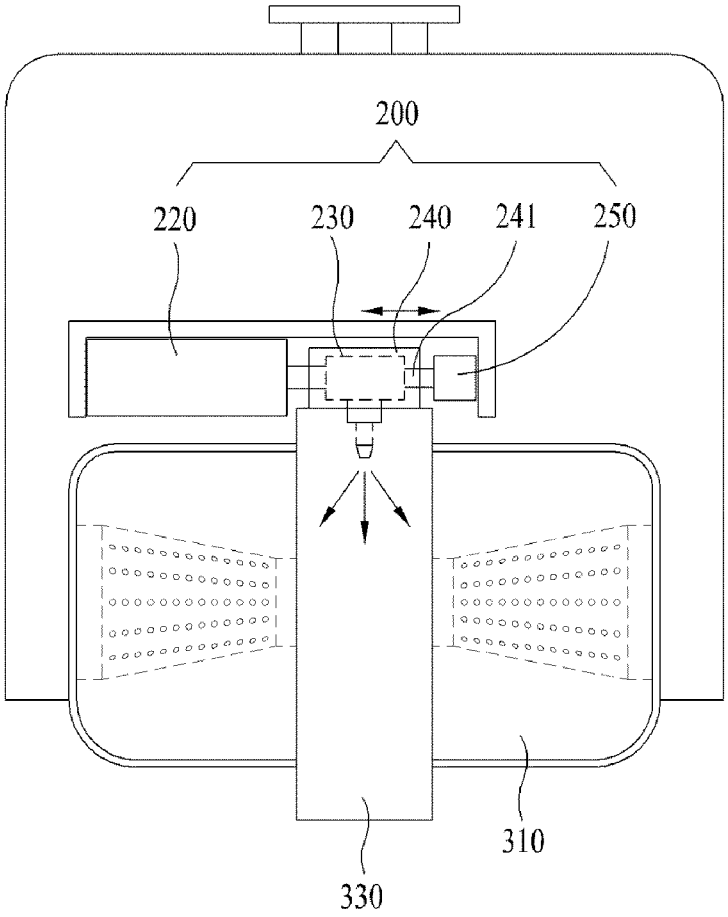
FIG. 10 is a plane view illustrating the liquid supply device and the dust separation device according to the third embodiment of the present invention.

As shown in FIG. 10, the spraying part 230 may be arranged in a center portion in rear of the outlet part 330 such that the liquid material may be dispersed broadly.

Because of that, the dust and foreign substances moving toward the outlet part 330 may be mixed with the liquid material more efficiently.

Figure 11:
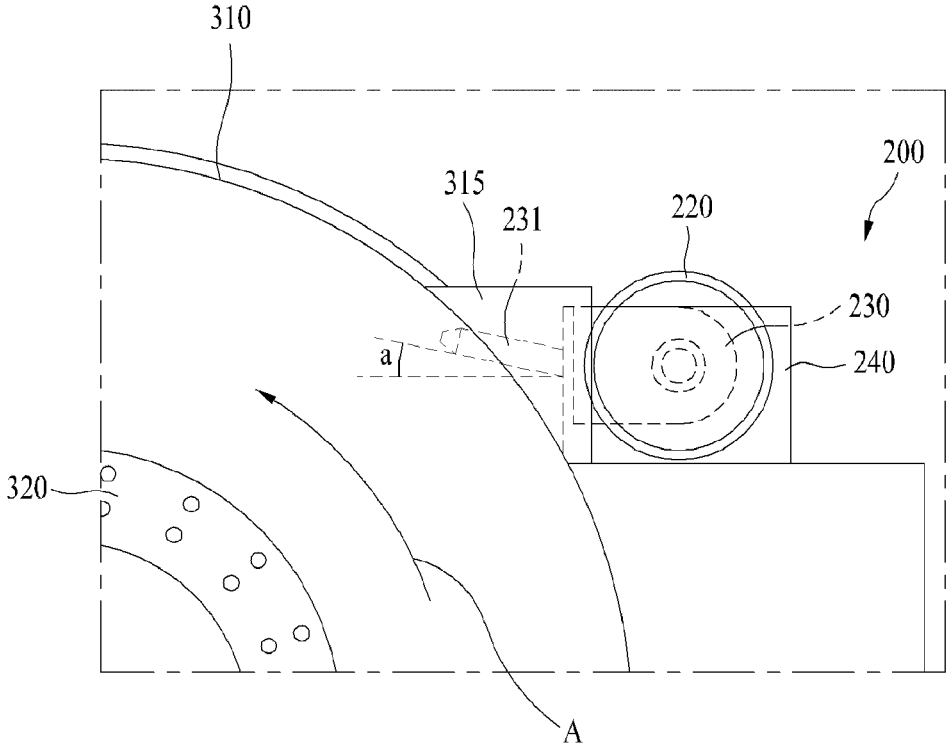
FIG. 11 is a side-sectional view illustrating the liquid supply device and the dust separation device according to the third embodiment of the present invention.

As shown in FIG. 11, the guiding tube 231 may be arranged oblique to a predetermined angle (a) toward the outlet direction (A) of the dust and other foreign substances, like the above embodiments. As mentioned in reference to the other embodiments, this oblique arrangement helps the liquid material to be mixed with the dust and other foreign substances more efficiently and it prevents the rotation of the dust and other foreign substances from being interfered with.

Here, if the dust and other foreign substances are rotated from the bottom toward the top of the body part 311, the guiding tube 231 may be arranged oblique upward.

Alternatively, if this rotation performed from the top toward the bottom, the guiding tube 231 may be arranged oblique downward.

As follows, the operation of the vacuum cleaner according to the present invention will be described in reference to corresponding drawings.

Figure 12:
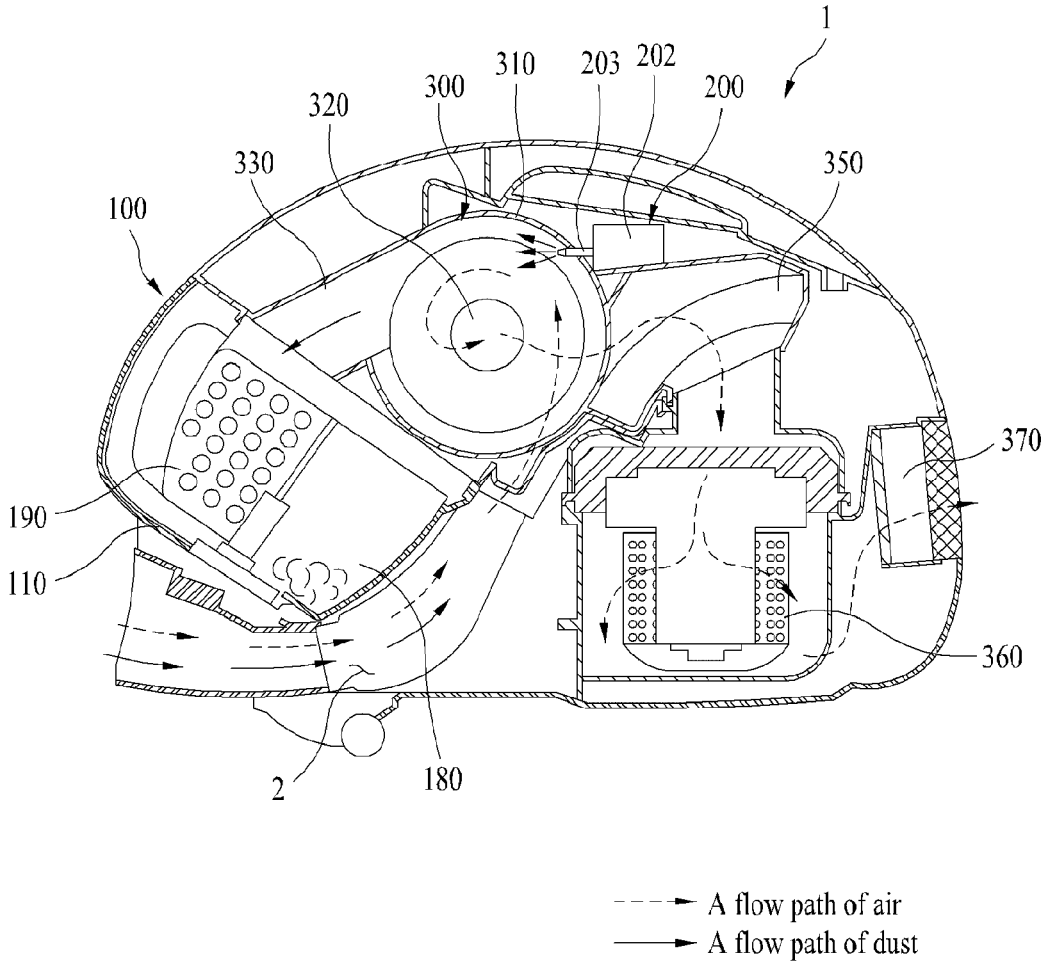
FIG. 12 is a side-sectional view illustrating the operation of the vacuum cleaner including the liquid supply device according to the first embodiment.

As shown in FIG. 12, once the vacuum cleaner starts to operate in case the liquid supply device 200 includes the storage part (201, see FIG. 3), the exhaustion pump 203 and the guiding tube 203, the air (referenced to as a dotted line) and the dust and other foreign substances (referenced to as a solid line) are drawn into the body part 310 of the dust separation device 300 along an inlet path 2.

The air drawn into the body part 310 of the cyclone system 300 passes the air outlet member 230, the first filtering unit 350, the motor unit 360 generating the vacuum pressure and the second filtering unit 360 only to be exhausted outside the body 1.

The dust and other foreign substances drawn into the body part 310 are rotated along the inner surface of the body part 310 by the centrifugal force.

At this time, the liquid material exhausted from the exhaustion pump 202 is sprayed into the body part 310 along the guide of the guiding tube 203 to be mixed with the dust and other foreign substances.

The dust and other foreign substances mixed with the liquid material accumulate in the dust collecting box 110 of the dust collection device 100 after passing the outlet part 330.

The rotating plate 190 provided in the dust collecting box 110 collects and presses the dust and other foreign substances mixed with the liquid material on both sides of the fixed plate 180, with moving toward the fixed plate 180, such that a dust mass may be formed.

Hence, if the user separates the dust collection device 100 from the body 1 and he/she reverses the dust collecting box 110 upside down to clean, the mass shaped duct and other foreign substances will fall.

Figure 13:
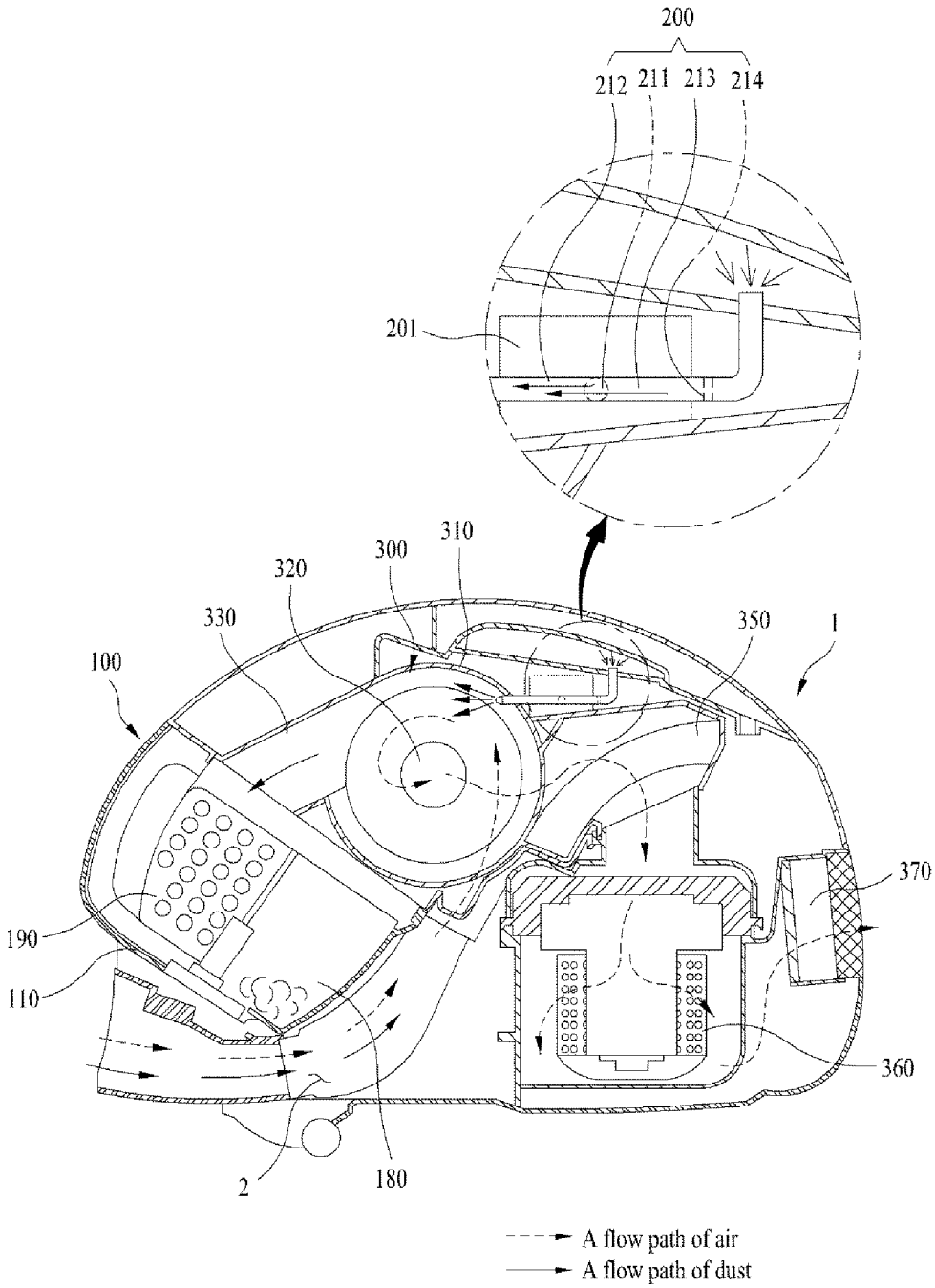
FIG. 13 is a side-sectional view illustrating the operation of the vacuum cleaner including the liquid supply device according to the second embodiment of the present invention.

As shown in FIG. 13, the operation will be described in case the liquid supply device 200 includes the storage part 201 and the first, second and third guiding tubes 211, 212 and 213.

The air (referenced to as a dotted line) and the dust and other foreign substances (referenced to as a solid line) are drawn into the body part 310 of the dust separation device 300 along the inlet path 2.

The air drawn into the body part 310 of the dust separation device 300 is exhausted outside the body 1, after passing the air outlet member 320, the first filtering unit 350, the motor unit 360 and the second filtering unit 370.

The dust and other foreign substances drawn into the body part 310 are rotated along the inner surface of the body part 310 by the centrifugal force.

At this time, the pressure inside the body part 310 is noticeably lower tan the pressure outside the body part 310 by the vacuum suction pressure of the motor unit 360.

As a result, the air is sucked toward the third guiding tube 213 and then the closable valve 214 is opened and the inside of the first, second and third guiding tubes 211, 212 and 213 is low-pressured in comparison to the inside the storage part 201 by the air flux.

Hence, the liquid material stored in the storage part 201 is drawn into the body part 310 by the air flow along the first and second guiding tubes 211 and 212.

The liquid material drawn into the body part 310 is sprayed to and mixed with the dust and other foreign substances.

The dust and other foreign substances mixed with the liquid material accumulate in the dust collecting box 110 of the dust collection device 100, after passing the outlet part 330.

The rotating plate 190 provided in the dust collecting box 110 collects and presses the dust and other foreign substances mixed with the liquid material on both sides of the fixed plate 180, with moving toward the fixed plate 180, such that a dust mass may be formed.

An end of the third guiding tube 213 may be connected to the outside of the body 1 to suck external air therein and the present invention is not limited thereto.

Figure 14:
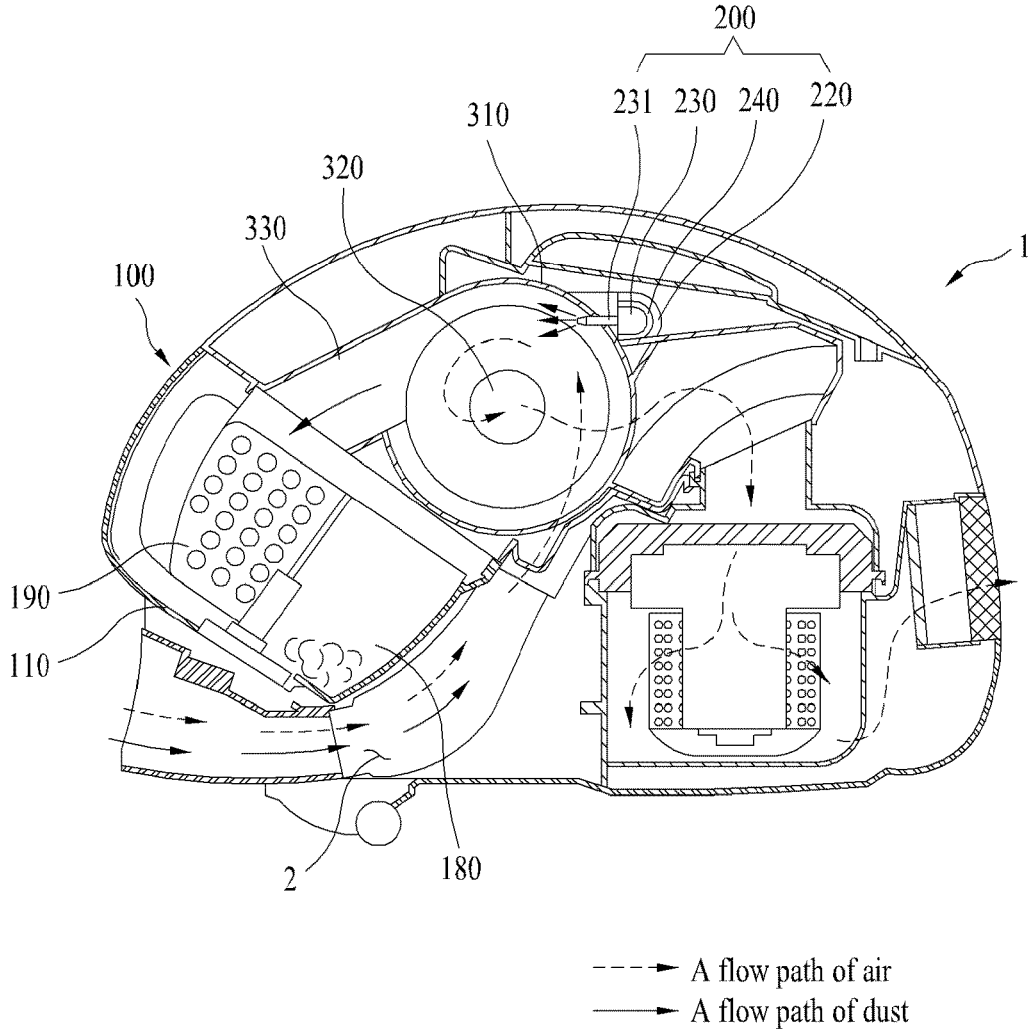
FIG. 14 is a side-sectional view illustrating the operation of the vacuum cleaner including the liquid supply device according to the third embodiment of the present invention.

As shown in FIG. 14, in case the liquid supply device 200 configured of the spray device includes the storage tank 220, the spraying part 230, the spraying housing 240 and the guiding tube 231, the operation of the spray type liquid supply device is substantially similar to those of the above embodiments.

Once air and dust and other foreign substances are sucked into the body part 310 by the operation of the vacuum cleaner, the dust and other foreign substances are moved along the inner surface of the body part 310 by the centrifugal force and the air is exhausted via the air outlet member 320.

If the button part (241, see FIG. 9) is pushed by the operation of the driving part (250, see FIG. 9), the spraying part 230 is operated and the liquid material inside the storage tank 220 is drawn into the body part 310 along the guiding tube 231 to be mixed with the dust and other foreign substances.

The dust and other foreign substances mixed with the liquid material are drawn and collected in the dust collection device 100 via the outlet 330. The dust collecting operation performed by the rotating plate 190 and the fixed plate 180 is identical to the operation mentioned above and description thereof will be omitted accordingly.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The present invention has following advantageous effects.

In case dust is collected in a dust collection device during the operation of the vacuum cleaner according to the present invention, liquid material having predetermined viscosity is exhausted from a liquid supply device. As a result, the liquid material is mixed with the dust only to prevent the dust from being scattered inside the dust collection device.

Furthermore, in case a user separates the dust collection device from a body to clean after making the dust and other foreign substances mixed with the liquid material into a mass, the user may throw out the dust and other foreign substances in a single mass shape, without scattering. As a result, user convenience may be improved.

What is claimed is:

1. A vacuum cleaner comprising:

a body;

a dust separation device mounted in the body;

a dust collection device independently provided from the dust separation device, connected to the dust collection device;

a compression device provided in the dust collection device, to collect dust and foreign substances collected in a predetermined portion of the dust collection device and to compress the collected dust and foreign substances; and a liquid supply device provided in the dust separation device to supply liquid material to an inside of the dust separation device.

2. The vacuum cleaner as claimed in claim 1, wherein the dust separation device comprises a body part having a predetermined space where air and dust and other foreign substances are rotated and the liquid supply device is provided in an outer surface of the body part.

3. The vacuum cleaner as claimed in claim 2, wherein the liquid supply device comprises, a storage part storing predetermined liquid material therein; and an exhaustion pump secured to the outer surface of the body part, connected to the storage part, to discharge the liquid material into body part.

4. The vacuum cleaner as claimed in claim 2, further comprising:

a guiding tube provided in the exhaustion pump to guide the liquid material into the body part, the guiding tube arranged oblique to a predetermined angel toward the rotation of the dust and other foreign substances.

5. The vacuum cleaner as claimed in claim 3, wherein the liquid supply device further comprises, a storage part storing liquid material therein; and a guiding tube secured to the outer surface of the body part, connected to the storage part, to guide the liquid material drawn into the body part by air drawn into the body part by difference of pressures inside and outside the body part.

6. The vacuum cleaner as claimed in claim 5, wherein the guiding tube comprises, a first guiding tube connected to the storage part;

a second guiding tube connected to the first guiding tube to be connected to the body part; and a third guiding tube connected to both of the first and second guiding tubes to guide external air toward the second guiding tub.

7. The vacuum cleaner as claimed in claim 6, further comprising:

a closable valve provided in the third guiding tube to open an inside of the third guiding tube if the third guiding tube sucks external air.

8. The vacuum cleaner as claimed in claim 6, wherein an end of the second guiding tube is inserted in the body part and the end of the second guiding tube is arranged oblique to a predetermined angle toward the rotation of the dust and other foreign substances inside the body part.

9. The vacuum cleaner as claimed in claim 2, wherein the liquid supply device is configured of a spray device and the liquid supply device comprises, a storage tank storing liquid material therein;

a spraying part provided in the storage tank to spray the liquid material; and a spraying housing secured to the body part to accommodate the spraying part.

10. The vacuum cleaner as claimed in claim 9, further comprising:

a button part provided in the spraying housing to operate the spraying part; and a driving part provided in a predetermined portion of the spraying housing, connected to the button part, to apply a pressure to the button part periodically.

11. The vacuum cleaner as claimed in claim 9, further comprising:

an extended part coupled to the spraying housing to be fixed to the body part, the extended part extended from a predetermined surface of the body part.

12. The vacuum cleaner as claimed in claim 9, further comprising:

a guiding tube connected to the spraying part and the body part to guide the liquid material into the body part via the extended part.

13. The vacuum cleaner as claimed in claim 4, wherein a diameter of an end of the guiding tube connected to the body part is substantially smaller than diameters of the other portions of the guiding tube to supply the liquid material to the body part in a spray condition.

14. The vacuum cleaner as claimed in claim 2, wherein the dust separation device further comprises an outlet part provided in a front portion thereof to discharge the dust and other foreign substances separated from air and the separated air outside and the liquid supply device is mounted in rear of the body part to supply liquid material to the dust and other foreign substances moved from a rear portion of the body part toward the outlet part.

15. The vacuum cleaner as claimed in claim 14, wherein the liquid supply device is detachably arranged in an outer surface of the dust separation device.

16. The vacuum cleaner as claimed in claim 12, further comprising;

a rib member provided in the dust separation device to surround and support the liquid supply device.

17. The vacuum cleaner as claimed in claim 1, wherein the compression device comprises, a fixed plate in the dust collection device; and a rotating plate rotatably provided in the dust collection device, contactable with the fixed plate, to collect the dust and foreign substances toward the fixed plate and to compress the collected dust and other foreign substances.

* * * * *